US005873299A

United States Patent [19]

Leykin

[11] Patent Number: 5,873,299

[45] Date of Patent: Feb. 23, 1999

[54] MACHINE AND METHOD OF DISPENSING FOOD ITEMS WITH EDIBLE INNER PART AND OUTER BAKED DOUGH PART

[76] Inventor: Leonid Leykin, 404 Pensacola Dr., Gathersburg, Md. 20878

[21] Appl. No.: 956,428

[22] Filed: Oct. 23, 1997

[51] Int. Cl.[6] ..... G07F 11/00

[52] U.S. Cl. ..... 99/357; 99/326; 99/334; 221/150 HC

[58] Field of Search ..... 99/357, 326, 327, 99/358, 335, 351, 334, 356; 221/150 HC

[56] References Cited

U.S. PATENT DOCUMENTS

| | | | |
|---|---|---|---|
| 2,390,277 | 12/1945 | Simpkins | 99/357 |
| 2,794,384 | 6/1957 | Sierk et al. | 99/357 |
| 3,117,511 | 1/1964 | Everett | 99/357 |
| 3,651,752 | 3/1972 | Roslonski | 99/357 |
| 5,522,310 | 6/1996 | Black, Sr. et al. | 99/357 |
| 5,555,793 | 9/1996 | Tocchet et al. | 99/357 X |

*Primary Examiner*—Reginald L. Alexander

[57] ABSTRACT

A machine for dispensing food items has a cooling unit for accommodating packages of edible inner part and separately outer baked dough part; a unit for opening a package with the edible inner part; a unit for withdrawing individual edible inner part from the open package; a unit for thermal processing of each edible inner part; a unit for opening a box with outer baked dough part; a unit for placing the thermally treated edible inner part into the outer baked dough part in the open package; a unit for warming up the outer baked dough part with the edible inner part located inside the outer baked dough part so as to form a finished food item; a unit for dispensing the thusly formed finished food item; and a transporting a unit for displacing packages with the edible inner parts, the individual inner part, the boxes with the outer baked dough part, and the finished food items between said preceding means.

15 Claims, 9 Drawing Sheets

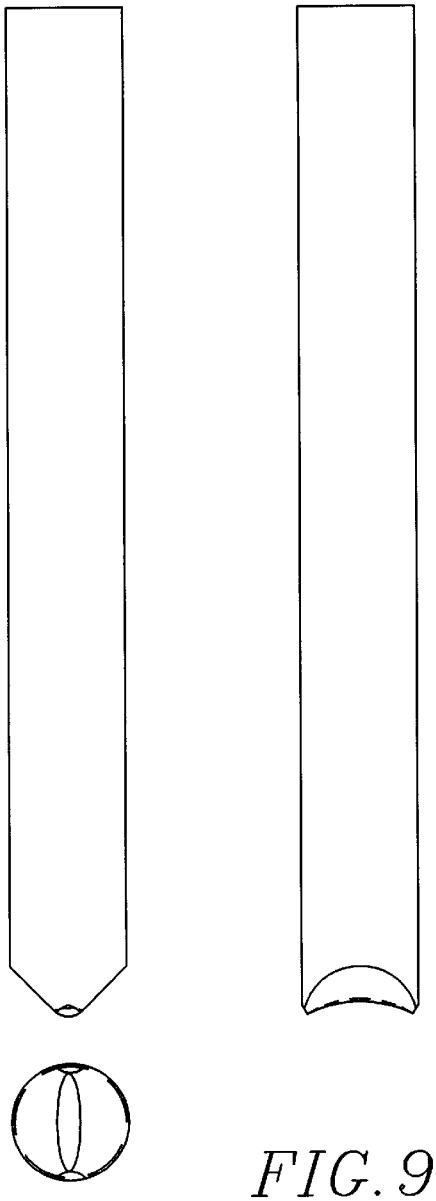
FIG. 9b
FIG. 9a
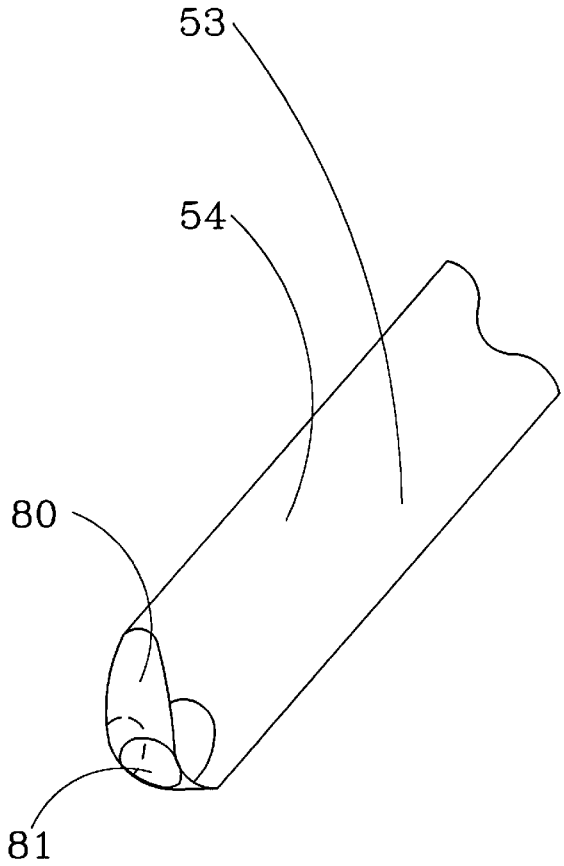
FIG. 9c

MACHINE AND METHOD OF DISPENSING FOOD ITEMS WITH EDIBLE INNER PART AND OUTER BAKED DOUGH PART

BACKGROUND OF THE INVENTION

The present invention relates to a machine and method of dispensing food items with edible inner part and outer baked dough part, in particular to a hot dog dispensing machine and to a method of dispensing hot dogs.

Hot dog vending machines are known in the art. One of such hot dog vending machines is disclosed in U.S. Pat. No. 2,390,277. In this reference a sausage and a roll are packed together. Heating of the sausage is performed by passing electric currents through it with electrodes which pierce through a pack of the sausage and roll. U.S. Pat. No. 2,794,384 discloses a machine in which the sausage and the roll are packed in a box, and the ends of the sausage project outwardly of the box. The heating of the sausage is performed by electric current passing through the sausage. Then, the ends of the sausage which touch the electrodes are cut off. In the machine disclosed in the U.S. Pat. No. 3,117,511 the sausage and the roll are packed together so that the sausage is arranged in a box above the roll of V-shaped so as to be supported on special cardboard spaces. The heating of the sausage is performed by passing of electric current through the sausage with the electrodes which pierce through the pack, and the roll is heated by a special heater introduced into a slot of the roll. In all these references the sausage and the roll are packaged and/or dispensed together. Since the sausage is packaged together with the rolls their storage has to be performed at a low temperature so that they are actually frozen to prevent spoilage of the sausage.

In all of the prior art the taste and flavor of the hot dogs was not attained because the components became stale before they were heated and the sausages were not properly grilled.

SUMMARY OF THE INVENTION

Accordingly, it is an object of the present invention to provide a hot dog vending machine which avoids the disadvantages of the prior art.

In keeping with these objects and with others which will become apparent hereinafter, one feature of the present invention resides, briefly stated, in a hot dog vending machine which has cooling means for separate storage of edible inner part, such as sausages in packages and of outer baked dough part, such as rolls in boxes and separately transporting the sausages and the rolls, means for individually removing and frying an edible inner part, means for cutting a box, means for introducing the fried edible inner part into an outer baked dough part, means for subsequent heating the edible inner part with the edible inner part in it, and means for dispensing the thusly produced food item, for example hot dog.

When the vending machine is designed in accordance with the present invention, it is a further improvement of the existing machines.

The present invention provides for separate storage of the sausages and the rolls under different temperatures so that both the meat and the baked dough preserve their respective freshness and flavor. In another critical improvement over the prior art, the invention provides for a means of extruding the sausages one by one from the standard plastic packaging. This improvement makes it possible to load sausages in the machine in their original hermetically scaled packaging which remains intact right until a few minutes before the sausage is used to make a hot dog for the customer. The present invention also provides for different means of thermal treatment for the sausage and the roll which is necessary to make the final product conform to the industry standard and consumer expectations.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIGS. 9*a*, 9*b*, 9*c* are a front view, a side view, and a perspective view of a extruder pusher for dispensing sausages from the dispenser of the inventive machine.

DESCRIPTION OF PREFERRED EMBODIMENTS

Figure 1:
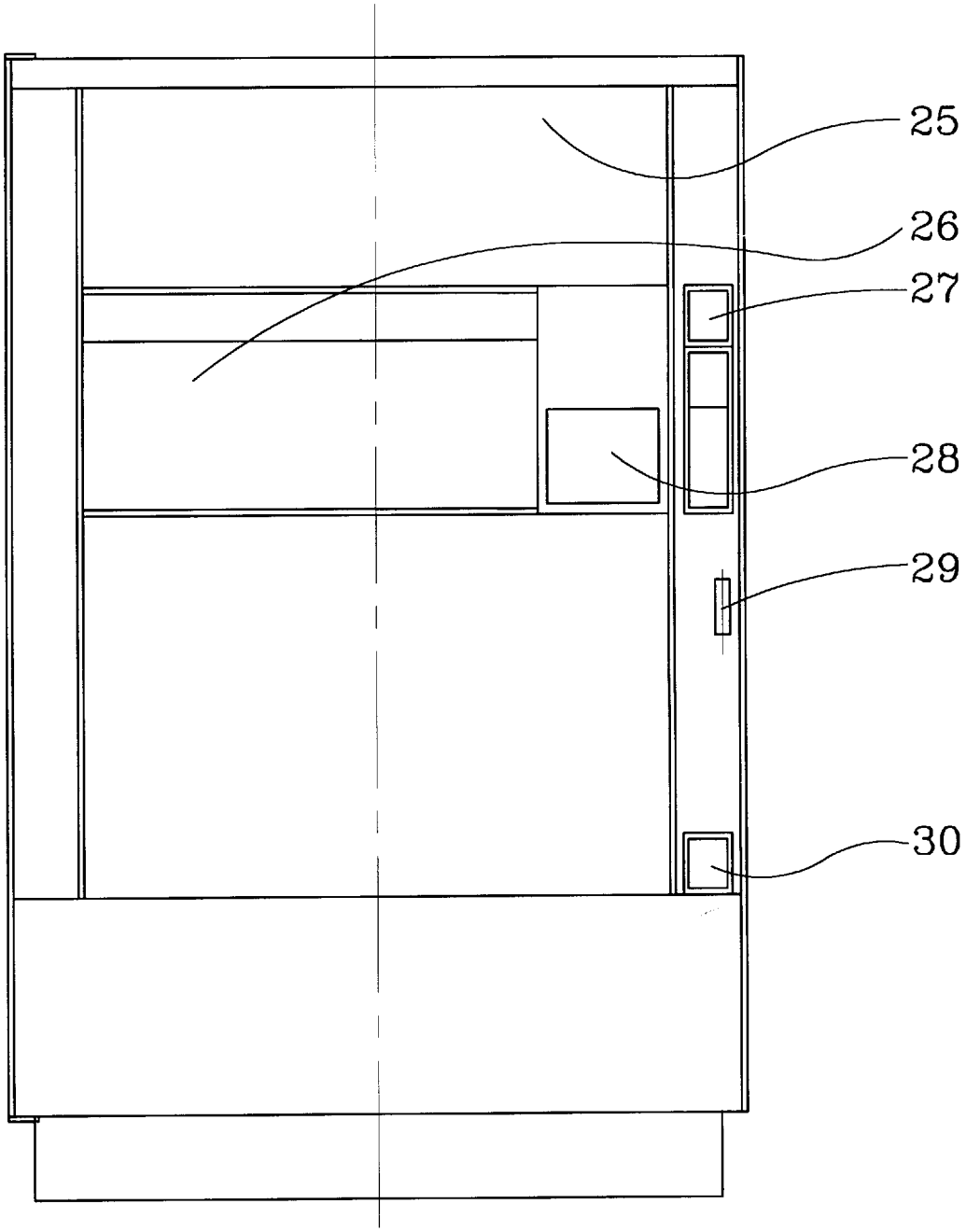
FIGS. 1 and 2 are a perspective view of an interior and a front view of a machine for dispensing food items with edible inner part and outer baked part in accordance with present invention.
Figure 2:
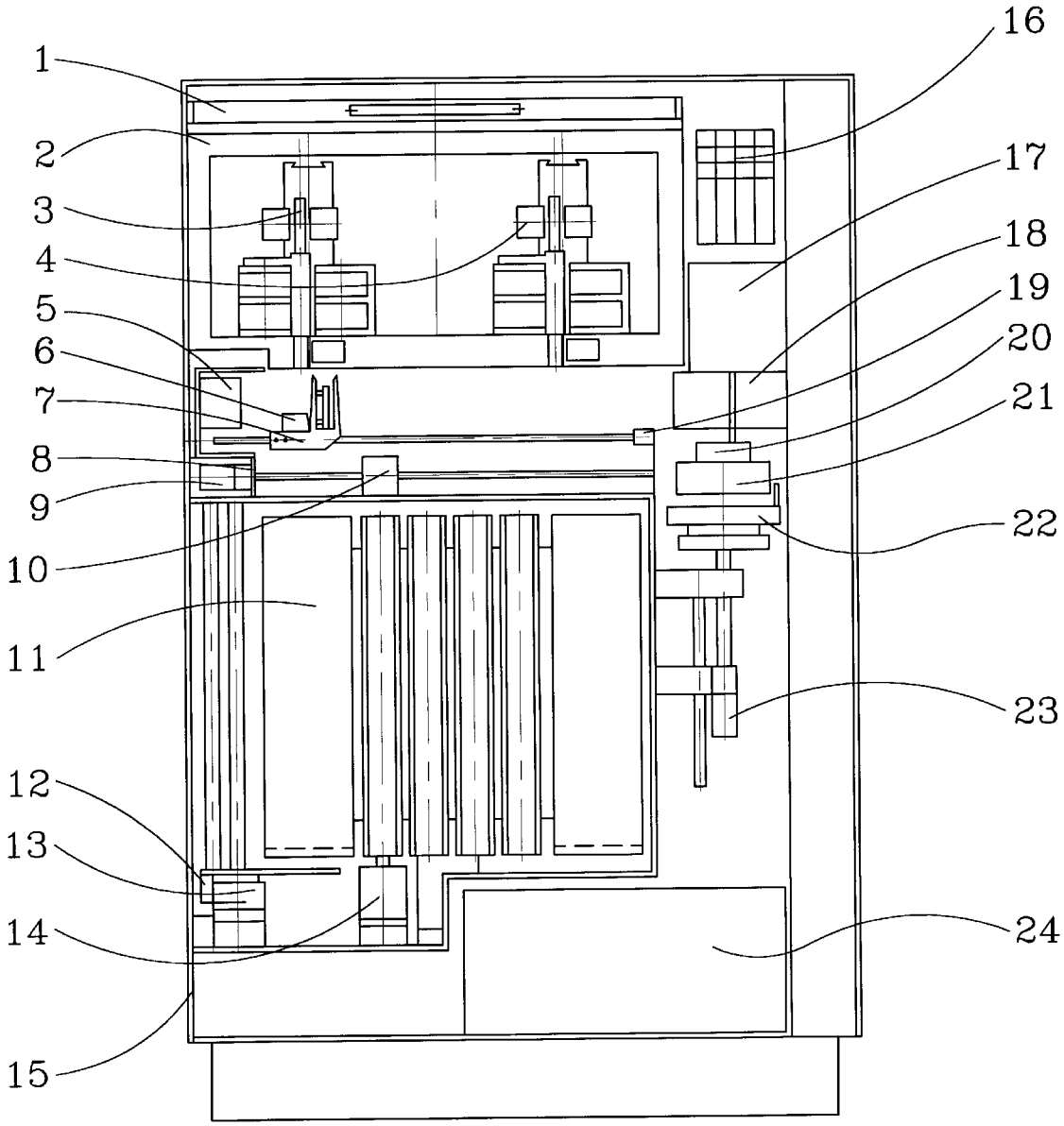
Figure 3:
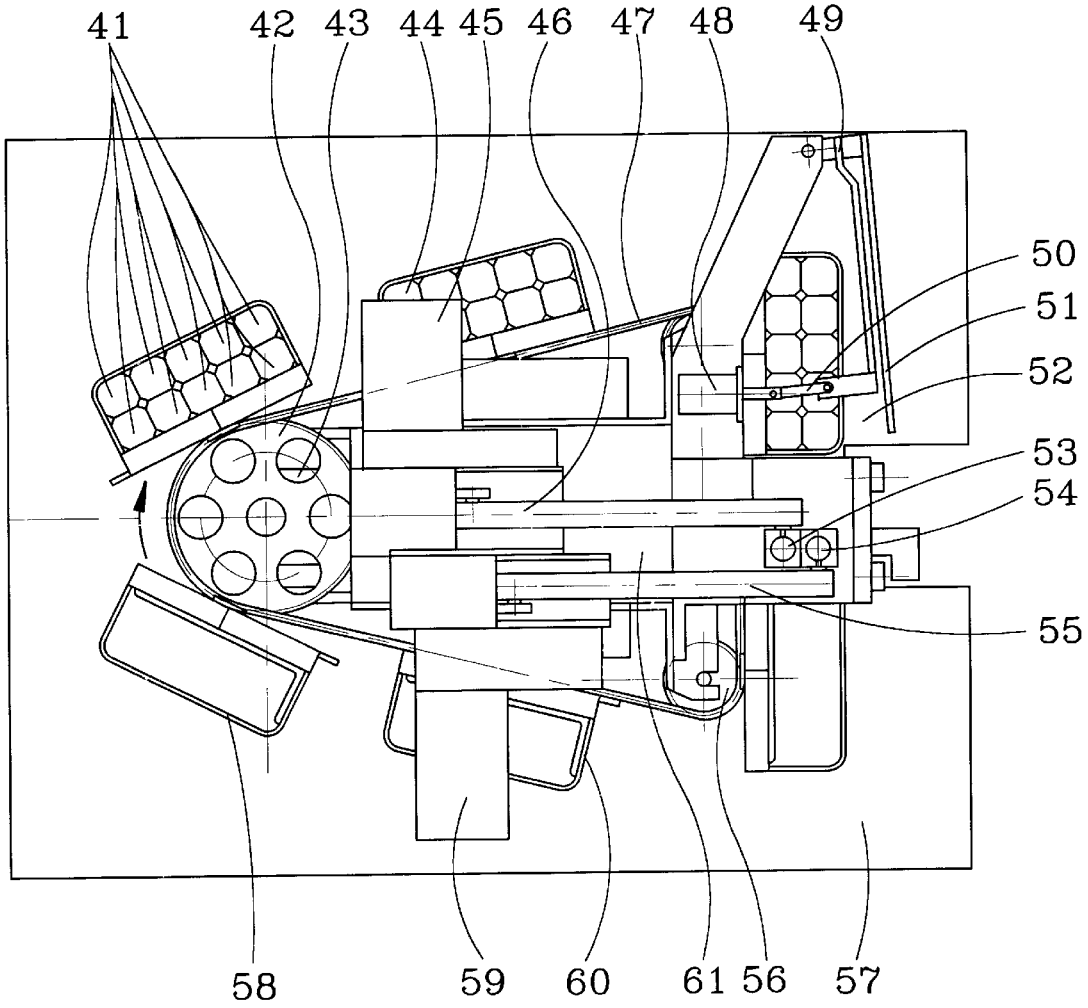
FIGS. 3, 4, and 5 are a top view, a side view and a front view of mechanisms located in a cooler of the inventive machine for dispensing food items with edible inner part and outer baked part.
Figure 4:
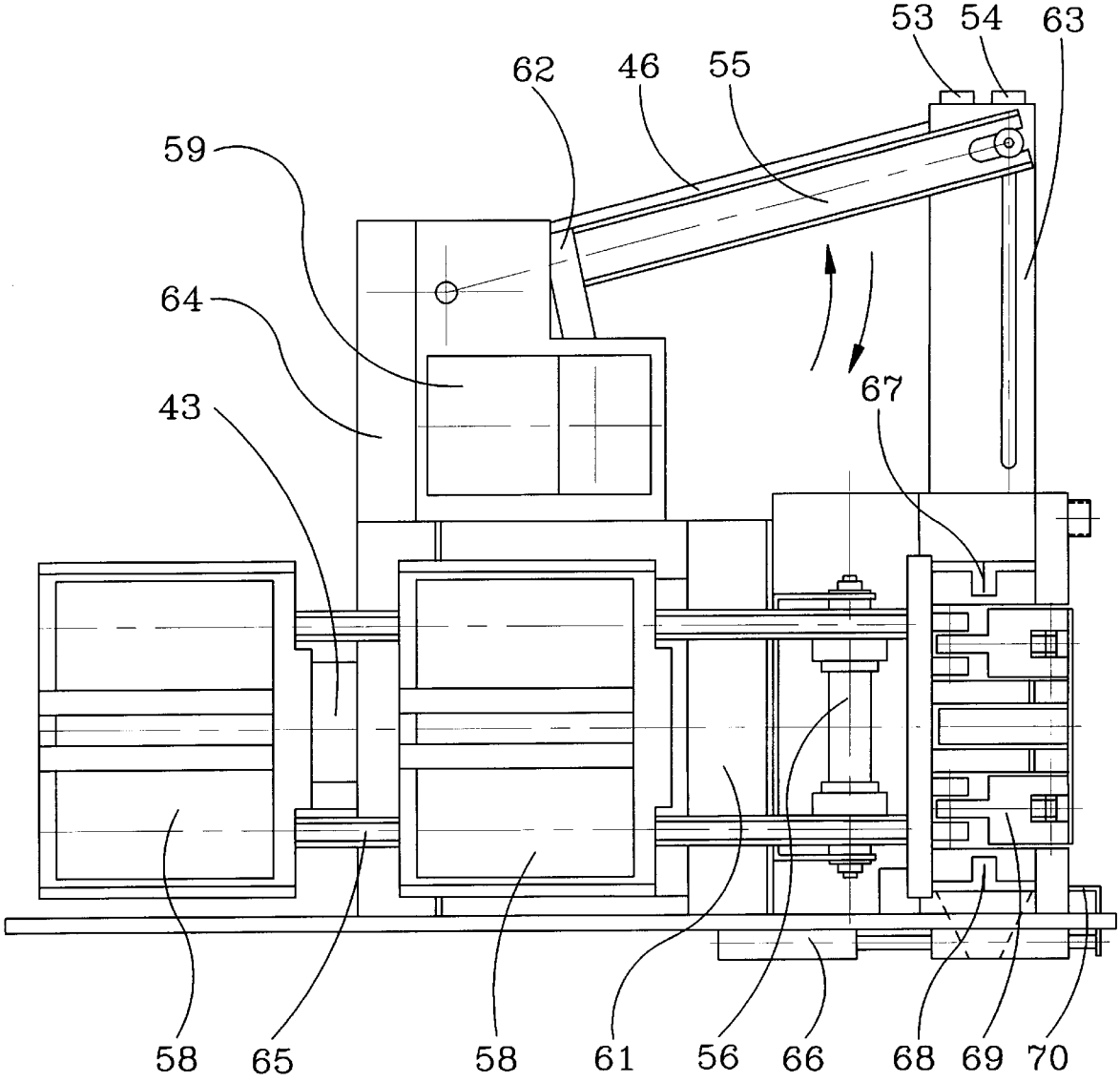
Figure 5:
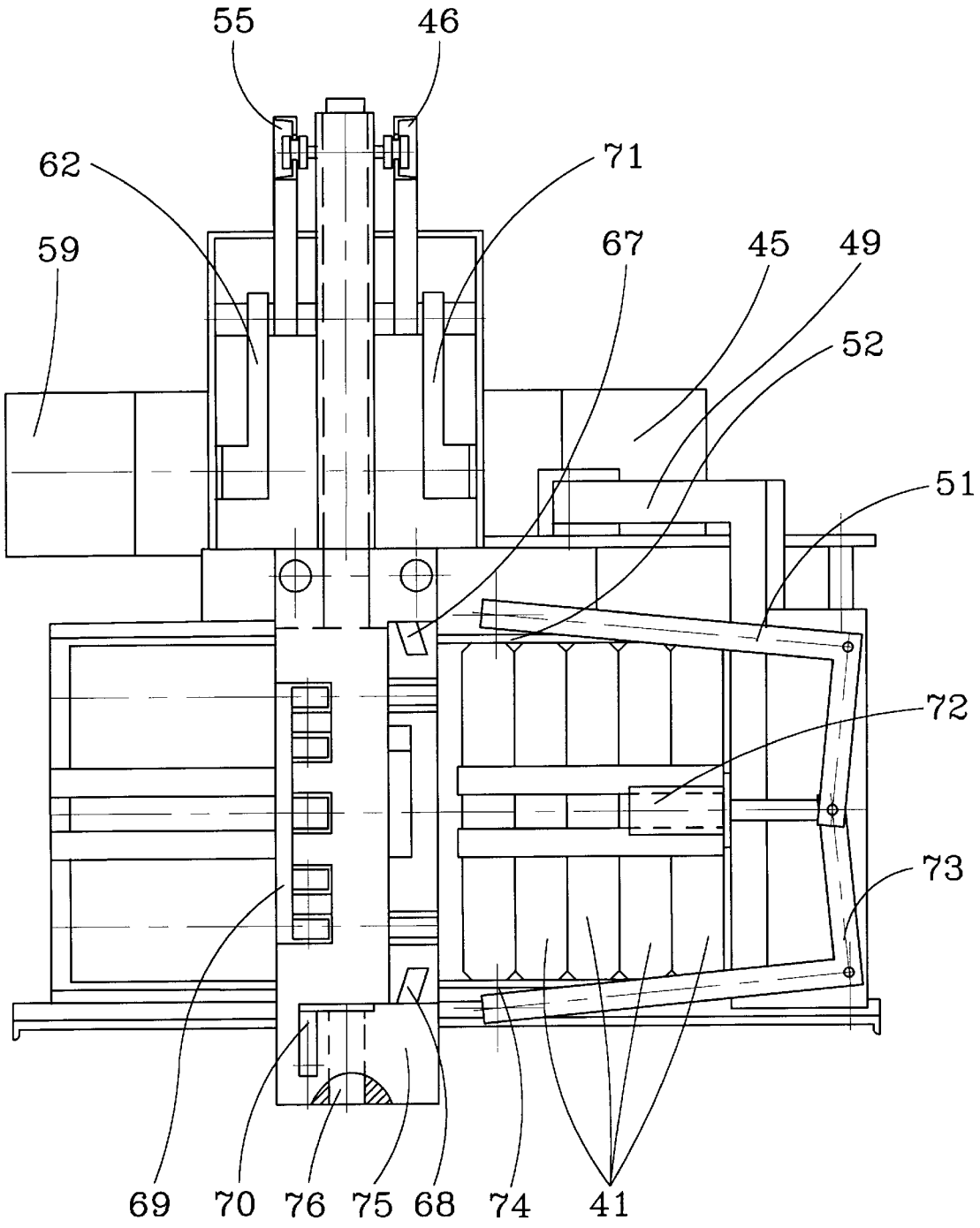
Figure 6:
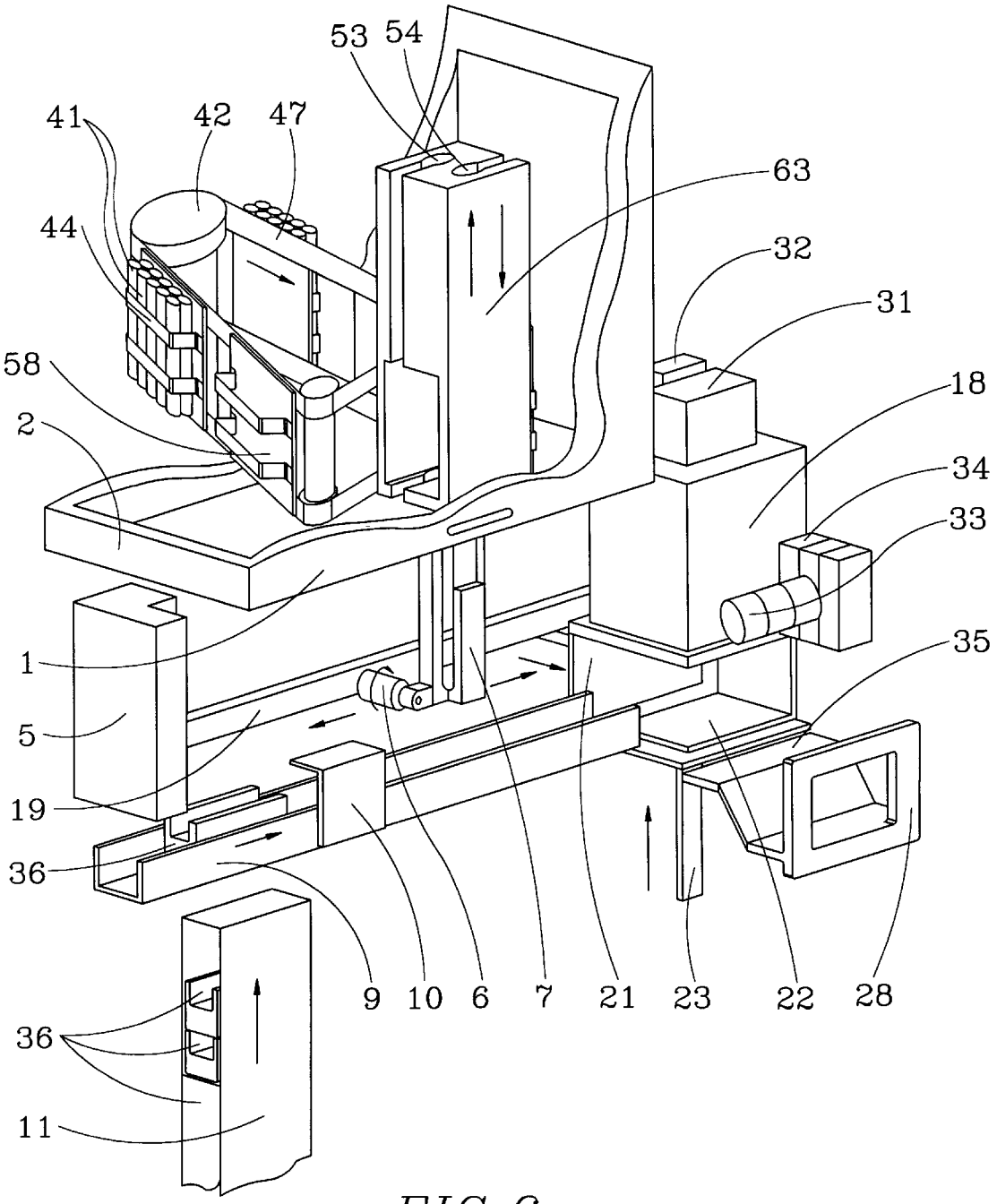
FIG. 6 is a schematic view of the process performed in the inventive machine for dispensing food items with edible inner part and outer baked part.

A machine for dispensing food items with edible inner part and outer baked part is illustrated as a machine for dispensing hot dogs in accordance with the present invention. It has a cooling chamber 2 which is used for storing initial components of a hot dog and has a door 1. Reference numerals 3 and 4 identify sausage dispensing mechanisms for withdrawing individual sausages S from standard sausage packages. The machine further has an infrared heater 5 for heating the sausages. Transporting means for transporting boxes with rolls R include a pusher 8, and a drive 9 for displacing the pusher. A box 36 with plastic windows and a roll for the hot dog is cut by a longitudinal cutting knife 10. A block of cassettes of boxes with rolls is identified with reference numeral 11. Transporting means for the boxes include a lifting element 12 for the boxes with rolls, a drive 13 of the lifting element, and a drive 14 for transporting the cassettes.

The machine has a cabinet 15. The machine further has a block for adjustment of a machine control 16, a device 17 for pouring condiments on a hot dog (HD), a microwave oven 18. Transporting means further include a drive 19 for a horizontal displacement of the sausage fork holder, a mechanism 21 for displacement of the sausage into a dispensing recess, a drive 20 for the mechanism 21, a platform 22 for lifting the hot dog into the microwave oven, and a drive 23 for the platform 22. The machine further has a compressor 24 for the cooling chamber, a door 25 with a window 26, a mechanism for receiving money 27, a dispensing cavity 28, a lock 29 for the machine door, a cavity 30 for returning money and change. 31 and 32 identify a launcher for a magnetron and the magnetron for the microwave oven correspondingly.

For pouring condiments on a hot dog the machine is provided with pumps 33 and vessels 34 with condiments such as mustard, catsup, etc. Reference numerals 35 identifies a guide for moving the hot dog from the microwave oven to the dispensing cavity. Reference numeral 36 identifies a box with a roll and reference numerals 41 and 44 identify a package with sausages and cassette with a sausage package.

A chain conveyor has a block of driving sprockets 42, a sprocket drive 43, an upper chain 47. The pusher has a drive 45 and a lever 46. The device for transverse cut of the packages has a magnet 48 for turning, a turning beam 49, a pulling rod 50 for the turning beam, a lever 51 for the transverse cutter, a cutter 51 for the transverse cut of the upper part of the package. A mechanism for dispensing sausages from the package includes pushers 53 and 54 for dispensing sausages and a lever 55. The two pushers are needed since the sausages in the package are arranged in two rows. The lower end of each pusher is concave to receive the convex end of each sausage.

Reference numeral 56 identifies a block of deviating sprockets of the chain conveyor. The mechanism for dispensing sausages has a base 57. A carrier with an empty package is identified as 58 while a drive of the pusher is 59.

The machine further has a casing 61 of the dispensing mechanism, a crank of the extruder drive 62, a guide 63 for the extruder, a casing 64 for the extruder drives, while the lower chain of the conveyor is identified as 65.

A magnet for a drive of a lid is identified as 66. 67 and 68 are cutters for the longitudinal cut of the top of the sausage package and the bottom of the sausage package correspondingly, 69 is a turning beam for fixation of sausages in the pack, while 70 is a partition for separate withdrawal of sausages, 71 is a crank for the extruder drive, 72 is a magnet for turning of the transverse cut beam, 73 is a lever of the transverse cut, 74 is a cutter for the transverse cut of the bottom of the package, 75 is a beam, 76 is an opening for exiting of the sausage.

The machine in accordance with the present invention operates in the following manner:

Sausages S are packed in a standard package including 8 or 10 sausages per package. Rolls R for hot dogs (HD) are preliminarily packed in individual boxes with a special window which is closed by a film, which during the operation is cut in order to introduce the sausage into the roll.

The packages with the sausages 41 are introduced into a carrier 44 which is suspended on the chain 47 of the chain conveyor, displacing the carrier 44 to a location for cutting of the package where the package is cut by the cutters 67, 68, and then to the dispensing location. Two vertical extruders 53, 54 in response to the signal from the mechanism 27 for receiving money alternatively push the sausage from the package in the cooling chamber into the fork holder 7 located outside of the cooling chamber through an opening 76 in the bottom of the cooling chamber. The package 41 is cut only immediately before dispensing, while other packages are still located in the cooling chamber and are closed. After all sausages are dispensed the carrier 58 with empty package is displaced, and another carrier with the full package are introduced into a dispensing location 78. The fork holder 7 together with the sausage is displaced by the horizontal drive 1 9 into the infrared heating device 5 located in the left part of the machine. In the heating device 5 the sausage is fried by infrared rays.

The packed roll in the box 36 is supplied from the cassette 11 upwardly onto the horizontal surface of the drive 9. Then the fork holder 7 with the fully fried sausage under the action of the pusher 8 moves further, the box with the roll is pushed through the transverse cut cutter 10 so that the box is cut open by the cutter. The turning device 6 turns the fork holder 7 and places the sausage into the roll located in the box 36. Then the pusher 8 continues pushing the box with the roll onto the platform 22 which raises the same into the microwave oven 18. The platform 22 at the same time closes the bottom of microwave oven. In the microwave oven the roll is warmed up. After the end of the warming up of the roll in the microwave oven, the platform 22 is lower, and transporting mechanism 21 pushes the package with the finished hot dog HD into the dispensing recess 28. The mechanism 21 stops under the mechanism for pouring condiments on the guide 35. Depending on the customer's desire, one, two or three pumps 33 are turned on and dispense the condiments directly on to the hot dog. After this step, the transporting mechanism 21 pushes the hot dog further into the dispensing cavity 28.

Figure 7:
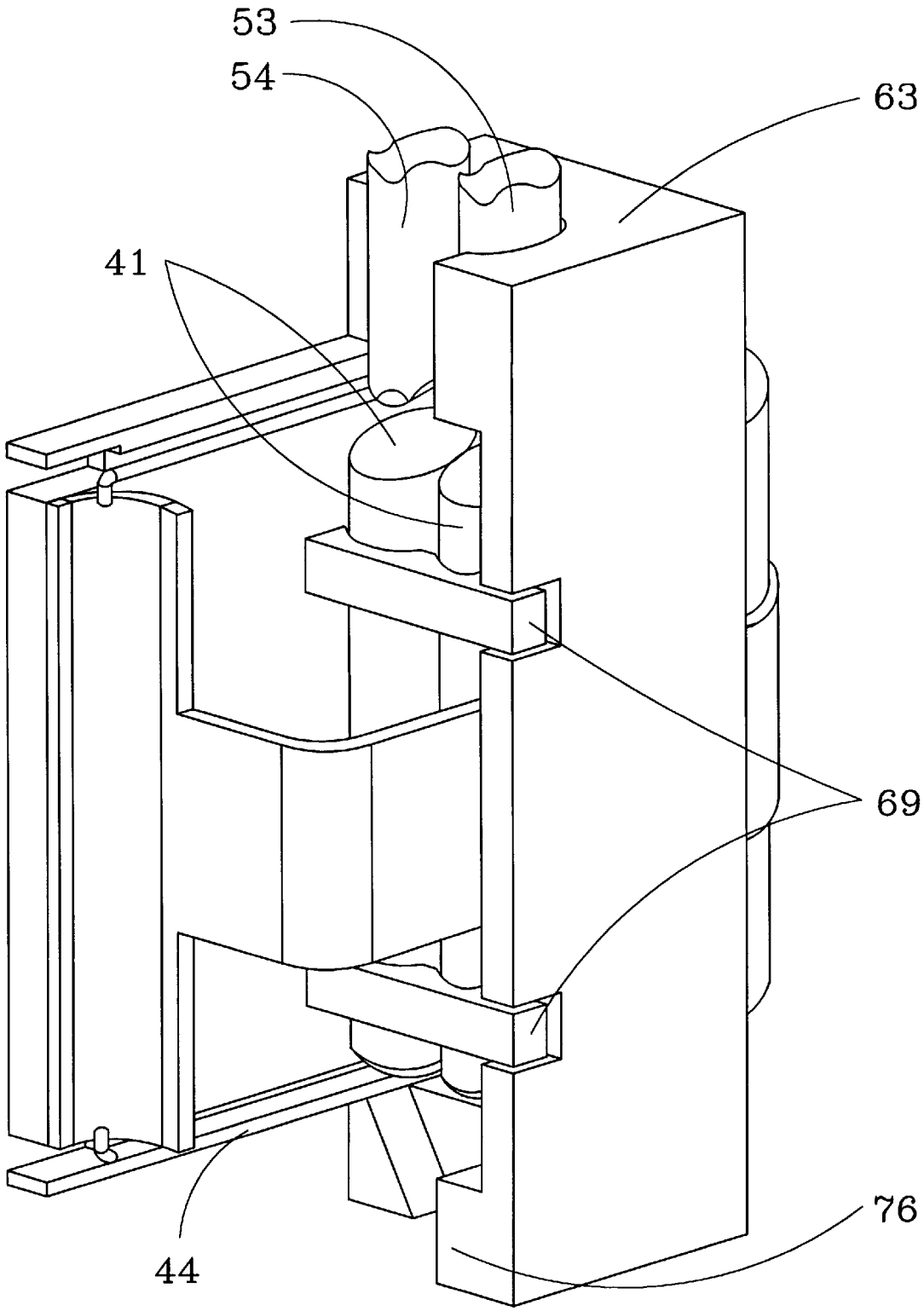
FIG. 7 is a perspective view showing a head of a dispenser of the inventive machine for dispensing food items with edible inner part and outer baked part.
Figure 8:
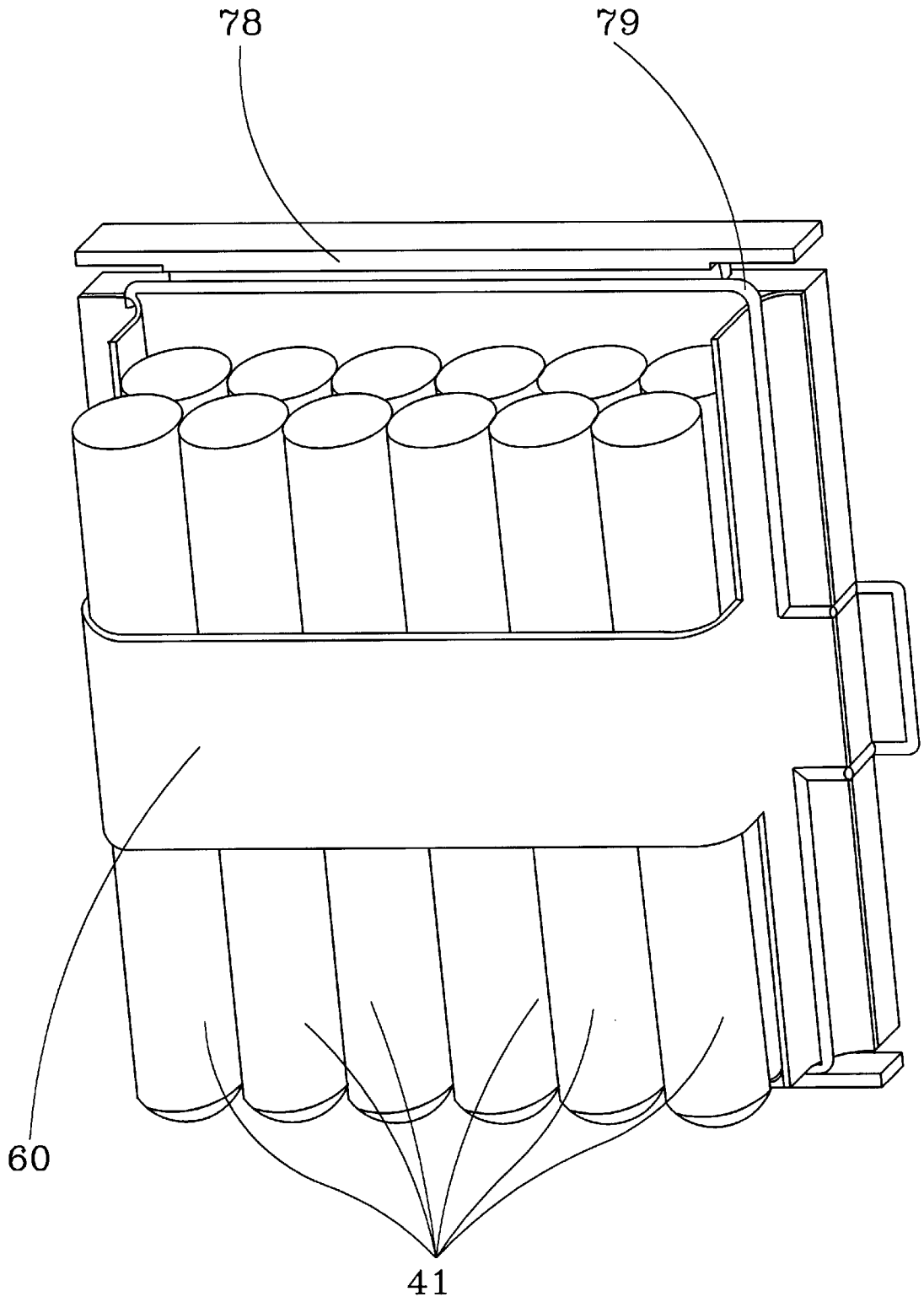
FIG. 8 is a perspective view showing a sausage package and carrier for the inventive machine.

The important feature of the present invention is a dispenser in which the sausages are dispensed from a package. The package 41 with sausages is held in the dispenser as shown in FIG. 7. Two extruders 53 and 54 push the sausages from the dispenser. The turning beams 69 have a side facing the sausages and are provided with two depressions at said sides. The turning beams are spring-biased toward the sausages, so that upon gradual removal of the sausages from the package, they follow the remaining sausages to retain them. As shown in FIG. 8 the sausage crosset 60 has a wire spring 79 which is depressed by a handle into a groove of a base 78 to hold the plastic package at right position. The sausage extruder 53 or 54 has two oppositely inclined surfaces 80 to facilitate penetration of the pusher through a cutout in the sausage package, and a curved front surface 81 substantially corresponding to the curvature of the sausage to abut against the sausage and to push out.

It will be understood that each of the elements described above, or two or more together, may also find a useful application in other types of constructions differing from the types described above.

While the invention has been illustrated and described as embodied in hot dog dispensing machine, and method of dispensing hot dogs, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A machine for dispensing food items, comprising cooling means for accommodating packages of edible inner part and separately outer baked dough part; means for opening a package with the edible inner part; means for withdrawing individual edible inner part from the open packages; means for thermal processing of each edible inner part; means for opening a box with outer baked dough part; means for placing the thermally treated edible inner part into the outer baked dough part in the open package; means for warming up the outer baked dough part with the edible inner part located inside the outer baked dough part so as to form a finished food item; means for dispensing the finished food item; and means for transporting packages with the edible inner part, the individual inner part, the boxes with the outer baked dough part, and the finished food items between said means.

2. A machine as defined in claim 1, wherein said means for opening package with edible inner parts and said means for withdrawing individual edible inner parts are located in said cooling means, said cooling means having a lower individual dispensing opening, said transporting means including a transporting element located outside said cooling means under said opening to receive each edible inner part withdrawn from the packages and dispensed outwardly through said opening.

3. A machine as defined in claim 1, wherein said withdrawing means include two extruders arranged for pushing two edible inner parts from two sausage rows in the package.

4. A machine as defined in claim 1, wherein said withdrawing means include extruder means for pushing individual sausages one after the other from the package.

5. A machine as defined in claim 4, wherein said pusher means include a extruder having a concave end for receiving a convex end of a sausage.

6. A machine as defined in claim 1, wherein said means for thermally treating an outer surface of the sausage include an infrared heater.

7. A machine as defined in claim 1, wherein said means for warming up the outer baked dough part with the edible inner part inside include a microwave heater.

8. A machine as defined in claim 1; and further comprising means for pouring a condiment onto the food item.

9. A machine as defined in claim 1, wherein said transporting means include pushing means for pushing the edible inner part from the package, and a fork holder which receives the pushed out edible inner part located in said cooling means.

10. A machine as defined in claim 9, wherein said fork holder is arranged to move the box with the outer baked dough part through said opening means.

11. A machine as defined in claim 10, wherein said transporting means further include means for turning the fork holder and placing the edible inner part into the open outer baked dough part in the box.

12. A machine as defined in claim 4, wherein said extruder means include a extruder having two inclined surfaces located opposite to one another to facilitate penetration of said extruder into a package with edible inner parts.

13. A machine as defined in claim 4, wherein said extruder means include a extruder having two inclined surfaces located opposite to one another for facilitation of penetration of said extruder into a package with edible inner parts, and a concave end for receiving a convex end of a outer baked dough part located between said inclined surfaces.

14. A machine as defined in claim 1; and further comprising a dispenser for holding a package with edible inner parts and dispensing edible inner parts from the package, said dispenser including a guide; at least one extruder moveable in said guide for pushing a sausage from the package with edible inner parts, at least one turnable holder which is turnable so as to follow the edible inner parts when preceding sausages are removed from said dispenser.

15. A machine as defined in claim 1; and further comprising a cassette for receiving a package with edible inner parts, said cassette including a bottom, a frame moveable toward the bottom so as to enclose the package with edible inner parts, and a spring element holding said frame to said base and introduceable into a groove of said base.

* * * * *